United States Patent [19]

Smitherman et al.

[11] 4,072,094

[45] Feb. 7, 1978

[54] METHOD FOR BUNDLING FIREWOOD

[75] Inventors: Stephen N. Smitherman, Loveland; Lemuel A. Dougherty, Longmont, both of Colo.

[73] Assignee: Big Elk Wood Corporation, Steamboat Village, Colo.

[21] Appl. No.: 648,618

[22] Filed: Jan. 12, 1976

Related U.S. Application Data

[62] Division of Ser. No. 513,006, Oct. 7, 1974, Pat. No. 3,939,762.

[51] Int. Cl.[2] ..... B65B 13/04

[52] U.S. Cl. ..... 100/3; 206/83.5

[58] Field of Search ..... 100/1, 3, 4, 25, 26, 100/32, 53, 269 R, 295, 2; 206/83.5, 321

[56] References Cited

U.S. PATENT DOCUMENTS

| | | | |
|---|---|---|---|
| 151,924 | 6/1874 | Shepardson | 100/3 X |
| 261,984 | 8/1882 | Baxter | 100/1 |
| 337,946 | 3/1886 | Greene | 100/257 X |
| 2,331,818 | 10/1943 | Wallace | 100/4 |
| 2,632,381 | 3/1953 | Buckland | 100/25 X |
| 2,982,063 | 5/1961 | Coleman | 100/1 |
| 3,195,445 | 7/1965 | Meisler | 100/26 |
| 3,470,814 | 10/1969 | Tschappu | 100/4 |
| 3,475,879 | 11/1969 | Merkel | 100/25 |

FOREIGN PATENT DOCUMENTS

| | | | |
|---|---|---|---|
| 72,979 | 3/1916 | Switzerland | 100/1 |
| 7,399 of | 8/1910 | United Kingdom | 100/3 |

*Primary Examiner*—Billy J. Wilhite
*Attorney, Agent, or Firm*—O'Rourke & Harris

[57] ABSTRACT

An apparatus and method is disclosed for bundling firewood. Relatively large pieces of wood, preferably first split and cut into convenient lengths, are compressed and while compressed have a strap applied therearound after which the applied pressure is released to form a bundle of firewood that is tightly banded. The apparatus includes a base section having a pair of spaced upwardly opening U-shaped members upon which the pieces of firewood are stacked with the end portions of the firewood supported by the U-shaped members. A pressure platen section is mounted above the base section and includes a second pair of U-shaped members that are downwardly directed and aligned with the U-shaped members of the base section so that, as the pressure platen is moved downwardly, the pieces of wood therebetween are compressed. The pressure platen section is moved upwardly and downwardly by a hydraulic ram and about eight tons of pressure is preferably exerted to compress and contour the wood into a cylindrical bundle. While compressed, a strap or band is applied centrally around the compressed wood bundle. An electro-pneumatic system is utilized to control the sequencing of the apparatus including automatic actuation of the hydraulic ram and application of the band to the compressed bundle.

12 Claims, 11 Drawing Figures

METHOD FOR BUNDLING FIREWOOD

RELATED APPLICATION

This application is a division of application Ser. No. 513,006, filed Oct. 7, 1974, and now issued as U.S. Pat. No. 3,939,762.

FIELD OF THE INVENTION

This invention relates to a wood bundling system and more particularly relates to a method for forming a tightly strapped bundle of firewood.

BACKGROUND OF THE INVENTION

It is oftentimes desired and sometimes necessary that wood be bundled into convenient small packages to facilitate conveying or transporting the package as well as making storage more convenient and enhancing safety where a considerable amount of wood must be stored. This is particularly true, for example, where firewood is concerned since such wood must normally be transferred, often to a variety of relatively small users, and stored by such users until needed.

While it has been common to cut and then store wood for ultimate use in wood-burning fireplaces, such storage has more often been accomplished by loosely stacking the wood, often by the cord, in some selected location and then transporting the same, sometimes piece by piece, to the burning area. This has not, however, proved to be convenient in many cases, and in some cases, inconvenient to the point of making a wood-burning fireplace impractical.

It is therefore been suggested that wood, such as kindling wood or other such small pieces, could be bundled. In these prior art suggestions, however, the type of wood bundled was relatively small and/or the device utilized was entirely mechanical. Examples of wood bundling devices of this type are shown, for example, in U.S. Letters Pat. Nos. 28,753 (Hobe), 66,254 (Richardson et al), 138,027 (House), 332,155 (Kingston), 369,603 (Kingston), 586,944 (Ball) and 1,985,462 (Schapiro).

It has also been suggested that compression and/or bundling systems could be utilized in other areas, such as, for example, bailing presses, clampers, or other compression devices (see, for example, U.S. Letters Pat. Nos. 204,741 (Jones), 262,611 (Nichols et al), 3,400652 (Hill et al), 3,496,862 (Sowerby) and 3,613,567 (Loughran)). However, such devices are not suggested for use in connection with wood bundling and/or do not suggest bundling systems that include such features as electro-pneumatic control members.

Heretofore, small firewood bundles have been attempted and/or utilized, but such bundling has not proved to be entirely suitable for providing a bundle of firewood that has a single strap securely and tightly fastening the bundle for conveying and/or storing the same.

SUMMARY OF THE INVENTION

This invention provides a method for bundling firewood that enables realization on a tightly bound bundle of firewood suitable for conveying and/or storing. The system includes wood engaging means that compresses pieces of firewood therebetween, and while maintained compressed, a strap is placed around the middle portion of the compressed bundle, after which the pressure applied by the wood engaging means is removed. An electro-pneumatic control system is utilized for automatic bundling and the resulting bundles are of relatively large size so as to be suitable to serve as fireplace logs.

It is therefore an object of this invention to provide an improved method for bundling of firewood.

It is another object of this invention to provide a firewood bundling method that provides a tightly bound bundle suitable for conveyance and/or storage.

It is yet another object of this invention to provide a firewood bundling method suitable for handling relatively large pieces of wood and bundle the same into a relatively heavy bundle of firewood suitable for use as fireplace logs.

It is still another object of this invention to provide a firewood bundling method that includes moving one pair of two pairs of spaced U-shaped members to compress pieces of wood therebetween to form and contour the wood into a substantially cylindrical bundle, the cylindrical bundle having a band placed therearound while compressed to form a tightly bound bundle. It is another object of this invention to provide an improved method for bundling firewood that includes applying pressure to the end portions of the wood pieces to compress the same and while compressed applying a strap around the middle portion of the bundle.

With these and other objects in view, which will become apparent to one skilled in the art as the description proceeds, this invention resides in the novel construction, combination, and arrangement of parts as substantially hereinafter described and more particularly defined by the appended claims, it being understood that such changes in the precise embodiment of the hereindisclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DETAILED DESCRIPTION OF THE INVENTION

Figure 1:
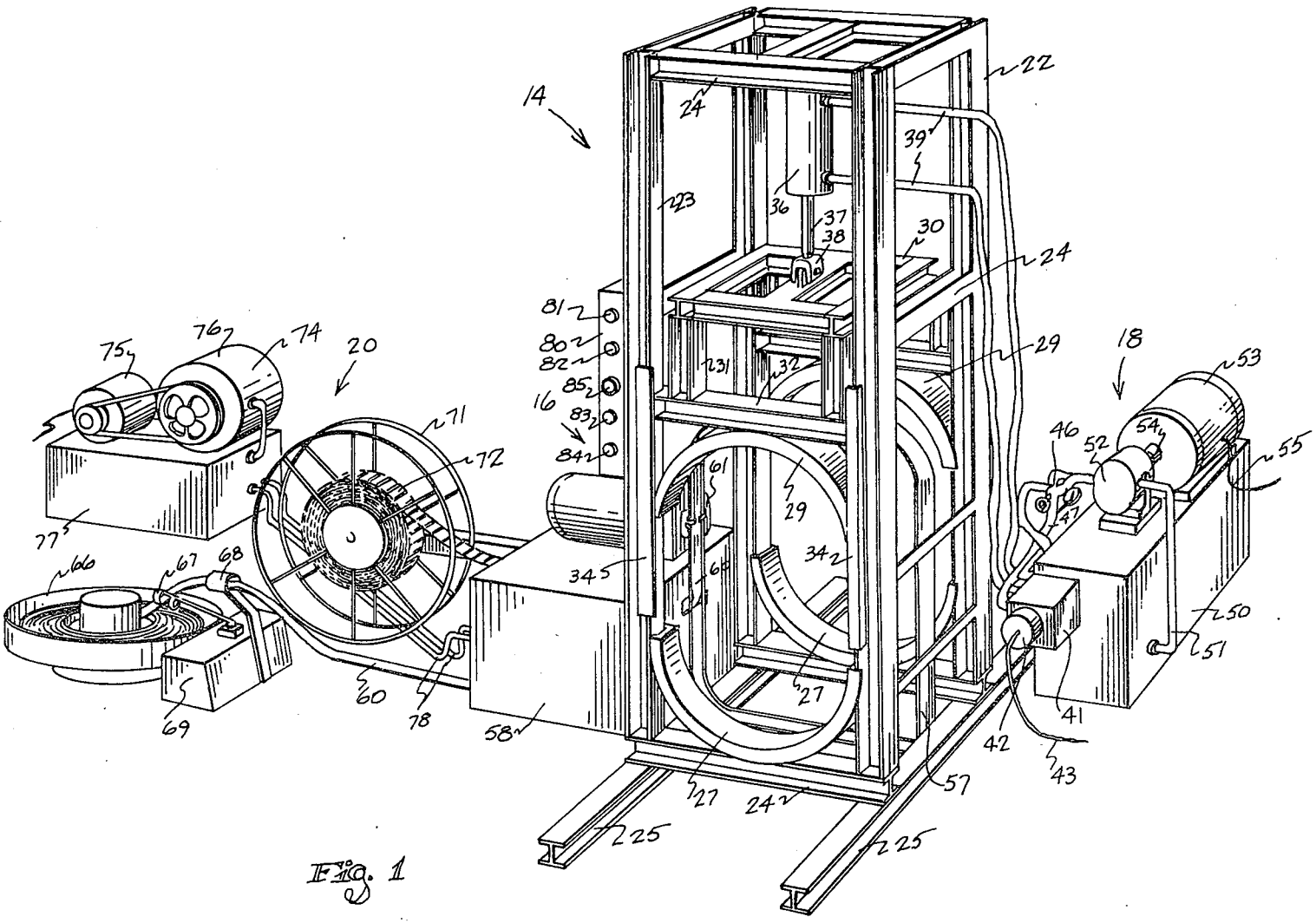
FIG. 1 is a perspective view of the firewood bundling apparatus of this invention.

Referring now to the drawings, the numeral 14 refers generally to the wood bundling apparatus of this invention. As shown best in FIGS. 1 and 2, wood bundling apparatus 14 preferably includes a compression section 16, a hydraulic actuation section 18, and a strapping section 20.

Pieces of wood are compressed and bundled at compression section 16 with a strap being applied to the compressed bundle prior to release of pressure on the bundle so that, when the bundle is removed from the compression section, a tightly strapped bundle is ready for conveyance and/or storage.

A frame assembly 22 is provided as a part of compression section 16, and frame assembly 22 includes four spaced vertical beams 23, preferably I-beams, joined at the top and bottom by a plurality of horizontal beams 24, also preferably I-beams. In addition, horizontal bottom support beams 25 may also be provided, again preferably I-beams. As shown best in FIG. 1, frame assembly 22 is, in essence, a rectangular box made up of connected I-beams and therefore very sturdy.

The bottom, or base, section of compression section 16 includes two upwardly-directed U-shaped members 27, the U-shaped members being spaced from one another and fixedly mounted to I-beams 23 and 24. As can be best seen from FIGS. 1 and 3, the width of each of the U-shaped members is slightly greater than that of the I-beams 23 and 24, and the distance between the ends of each U-shaped member is slightly less than the spacing between vertical beams 23 so that the ends of the U-shaped members are contiguous to the beams 23 when in position. The bottom of each of the U-shaped members preferably engages a beam 24 and each U-shaped member preferably has flanges at the edges thereof.

The pressure platen section of compression section 16 includes a pair of downwardly facing U-shaped members 29 above aligned with lower U-shaped members 27. Hence, upper U-shaped members 29 are spaced from one another and have the end portions of each contiguous to a beam 23 in the same manner as does U-shaped section 27 so that, as U-shaped members 29 are brought toward U-shaped members 27, the end portions are brought into contiguous relationship at which point the two interior surfaces of adjacent U-shaped members form substantially a cylindrical configuration wood compression, or work, area. Hence, wood compressed between the U-shaped members will be forced to assume a predetermined contour as well as to be compressed. As shown, the contour selected for the exterior of a compressed bundle is cylindrical. Obviously, if desired, other configurations could be achieved through use of members other than U-shaped members 27 and 29, but such members have been found preferable for use in this invention.

Figure 2:
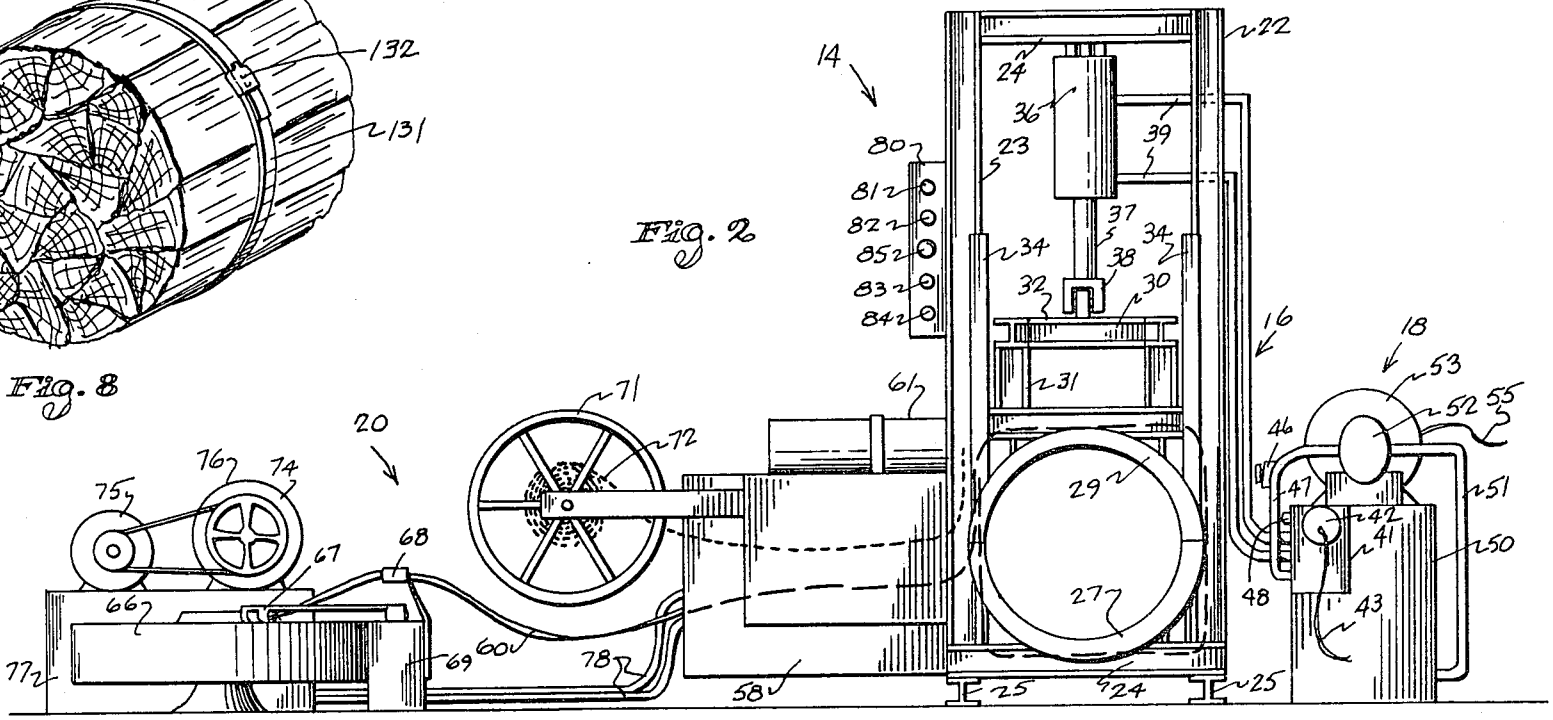
FIG. 2 is a side view of the firewood bundling apparatus shown in FIG. 1.

U-shaped members 29 are mounted on movable frame assembly 30, which frame assembly, as shown in FIGS. 1 and 2, includes a plurality of vertical I-beams 31 joined to a plurality of horizontal I-beams 32. Beams 32 are shorter than those of the overall frame assembly beams 24 and the vertical beams 31 are quite short with respect to vertical beams 23 so that frame assembly 24 is movable in vertical directions within frame assembly 22. As shown in FIGS. 1 and 2, the central portion of the curved section of U-shaped members 29 are fastened to horizontal beams 32 of movable frame 20, while the end portions are contiguous to beams 23 but movable with respect thereto. Hence, as frame assembly 30 is moved upwardly and downwardly within frame assembly 22, U-shaped members 29 are moved towards and away from U-shaped members 27. Guides 34 are preferably attached to a portion of beams 23 adjacent to the end portions of movable U-shaped members 29 and horizontal beams 32 of movable frame 30 to constrain the movable frame assembly 30 and U-shaped members 29 to a vertical path of travel, that is upwardly and downwardly within frame assembly 22 toward and away from the base section which includes U-shaped members 27.

The compression platen section (which includes movable frame 30 and U-shaped members 29) is moved in reciprocal vertical directions by means of hydraulic ram assembly 36. A ram 37 is connected at its free end to frame assembly 30 in conventional fashion, as by pivot connection 38, for example, which pivot connection is mounted on a central horizontal beam 32 of upper frame assembly 30. Hydraulic ram assembly 36 actuates the platen section by fluid, preferably oil, supplied thereto through hydraulic lines 39 connected to valve 41 in hydraulic actuation section 18.

Figure 11:
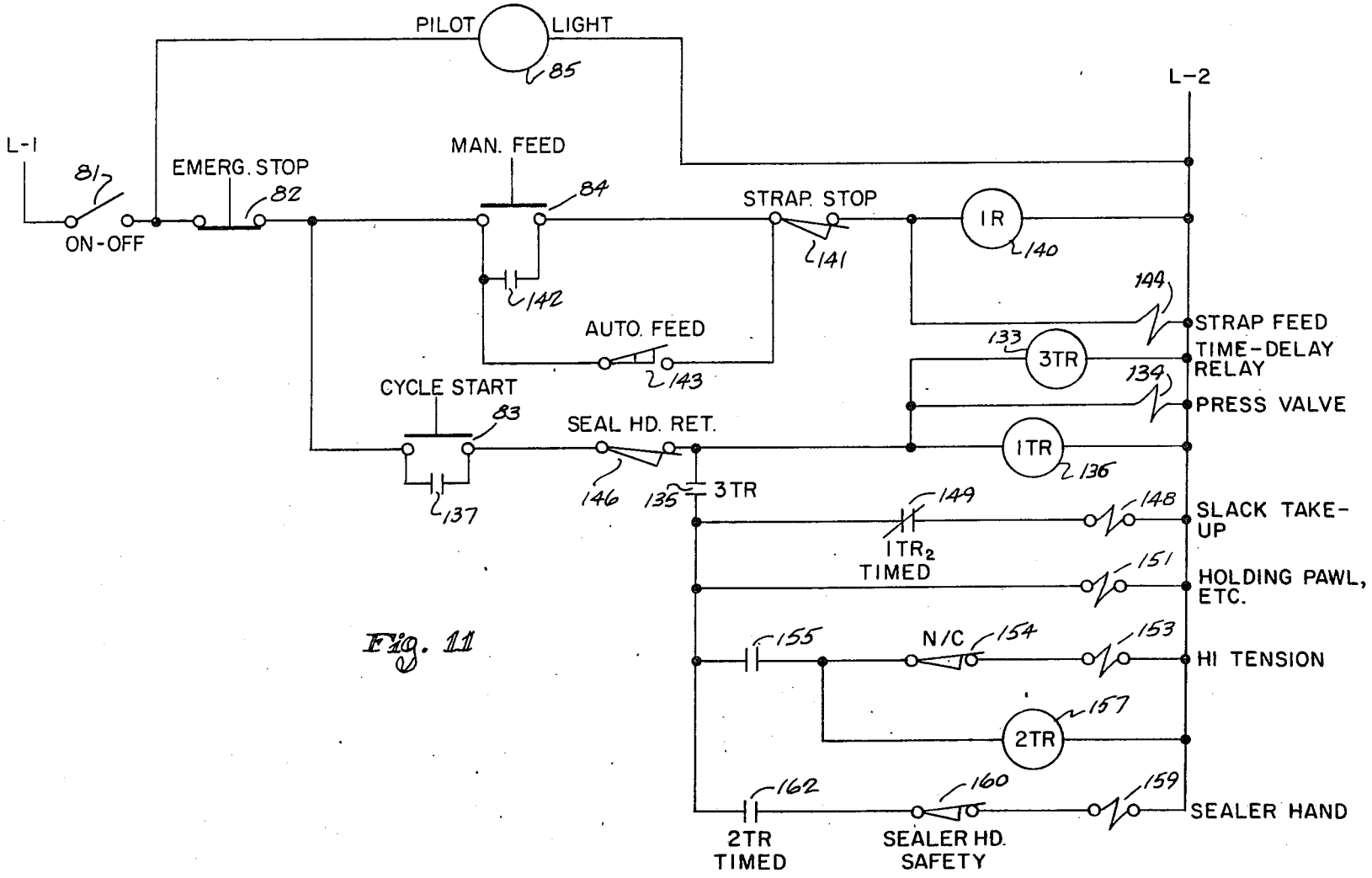
FIG. 11 is an electrical diagram of the electrical control system utilized in the firewood bundling system of this invention.

Valve 41 in hydraulic actuation section 18 is controlled by solenoid 42 having electric lines 43 leading to a conventional power supply as brought out in FIG. 11. As indicated in FIG. 9, valve 41 can be biased by a conventional spring 44 to normally remain in the position as shown except when moved to an actuate position to lower the press platen section by energization of solenoid 42.

Figure 9:
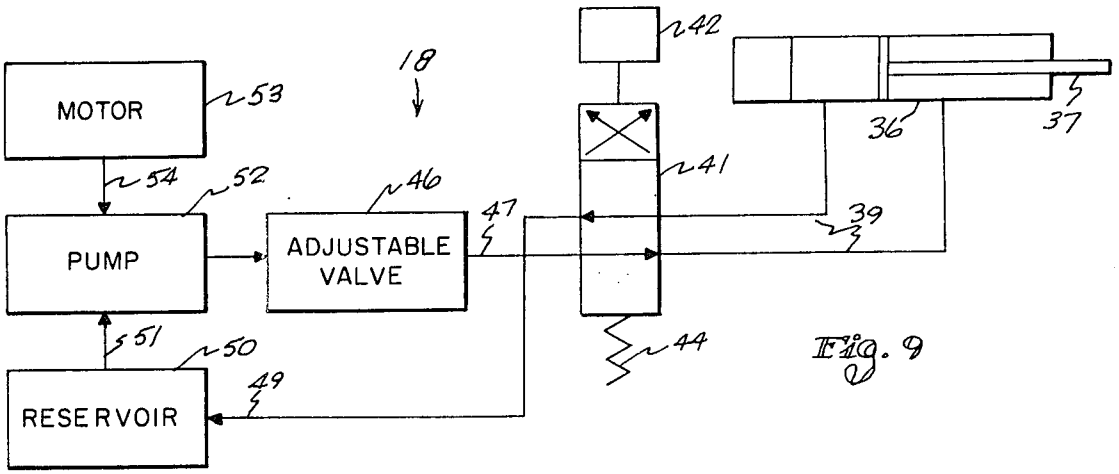
FIG. 9 is a schematic flow diagram of the hydraulic ram system utilized in the firewood bundling system of this invention.

As shown in FIG. 1, and as indicated in FIG. 9, one fluid connection to valve 41 is through an adjustable valve 46 (shown in FIG. 1 as being hand adjustable) connected to valve 41 through fluid conduit 47. The remaining fluid connection of valve 46 is through conduit 49 to reservoir 50. A second conduit 51 leading from reservoir 50 is coupled to pump 52. Pump 52 is actuated by electric motor 53 having shaft 54 thereon connected to pump 52, and electric motor 53 is energized by means of electric motor leads 55, as indicated in FIG. 1.

As indicated in FIG. 9, pump 52 pumps fluid from reservoir 50 through line 51, adjustable valve 46, line 47, and valve 41 to hydraulic cylinder, or hydraulic ram assembly, 36 to drive ram 37 when solenoid 42 is energized to move valve 41 to the actuate position (opposite to that shown in FIG. 9). Pump 52 supplies hydraulic pressures to ram 37 in the range of about 5 to 15 tons, with about 8 tons of pressure being prefferred. The fluid return to the reservoir is through line 49. In the position of cylinder 41 (normal position with solenoid 42 de-energized) as shown in FIG. 9, the ram is retracted and the U-shaped members are spaced apart, as shown in FIG. 1.

Figures 3, 10:
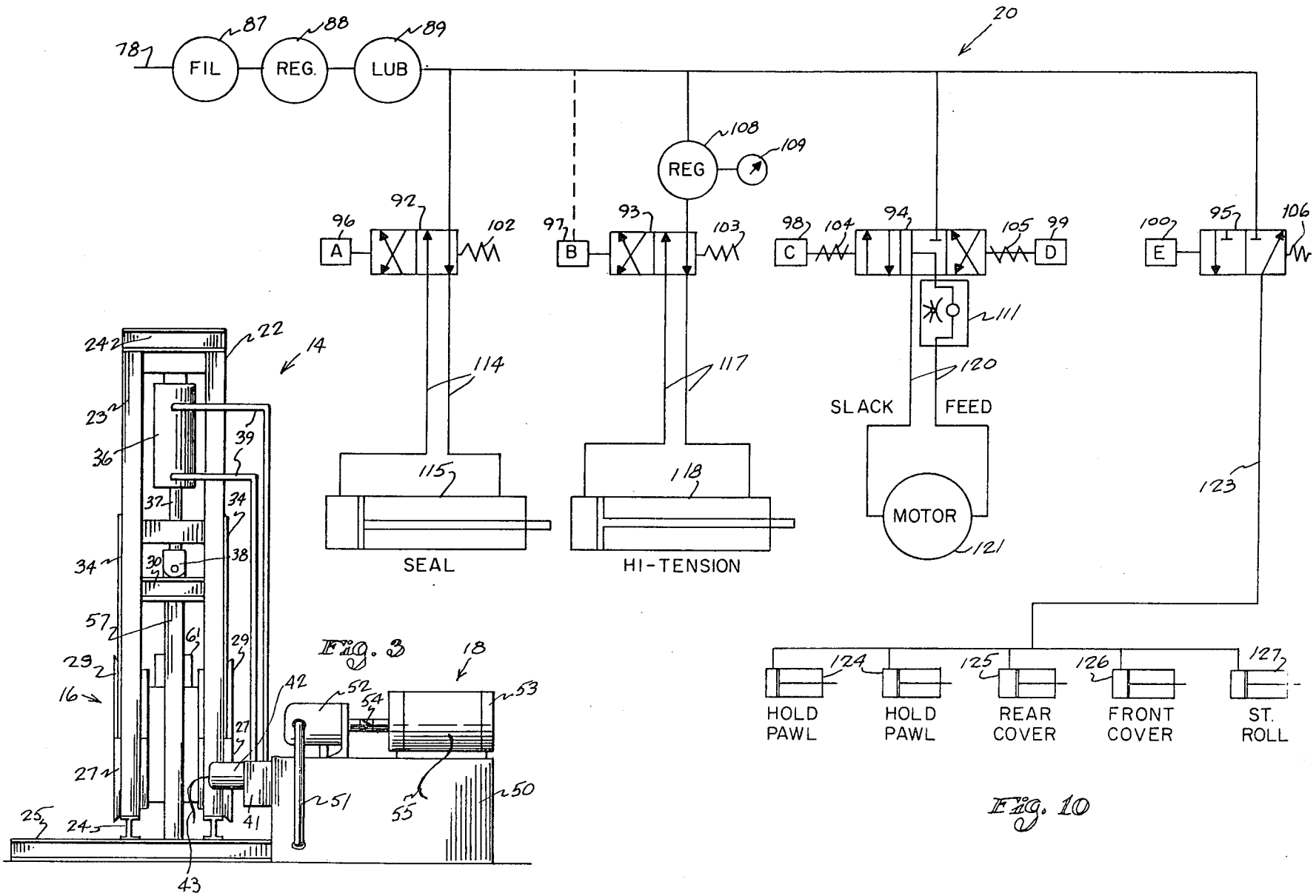
FIG. 3 is an end view of the firewood bundling apparatus shown in FIG. 1.
FIG. 10 is a schematic flow diagram of the pneumatic control system utilized in the firewood bundling system of this invention.

Turning now to strapping section 20, a strapping track 57, having conventional spring biased covers (not shown) over the track to form a channel through which a strap is conducted, is mounted centrally in the compression section 16 between the pairs of U-shaped members 27 and 29 as indicated best in FIGS. 1 and 3. For purposes of mounting, the strapping section may be conventionally attached to adjacent beams 23 and 25 as desired and the frame assembly can be provided with additional bars between the horizontal beams 23 to aid in this attachment if desired, as shown in FIG. 1. Strapping section 20 may be conventional, and an example of a strappling assembly and strapping track may be found in U.S. Letters Pat. No. 3,400,652 to W. J. Hill et al. In addition, such strapping systems as are shown herein are commercially available, for example, from A. J. Gerrard & Company of Des Plaines, Illinois, and one such strapping system that has been utilized herein is detailed in the A. J. Gerrard & Company Manual, O. I. 2675, entitled "The Automatic 2675 Strapping Machine." As is conventional, the covers are spring biased to the closed position so that a strap is maintained in the channel and may be fed therethrough except when pulled from the channel when the strap is tightened around a wood bundle.

As shown in FIGS. 1 and 2, the strapping section includes a control unit 58 through which is fed strapping wire, or bank, preferably steel banding material, 60. AS is well known, it is necessary that steel banding when applied be sealed, or fastened, together and this is accomplished through a conventional sealer unit 61. As indicated in the drawings, control unit 58 conventionally includes feed roller 63 such as the feed roller shown in U.S. Pat. No. 3,475,879, for example, in contact with banding material 60 to feed band, or strap, through the channel formed in strapping track 57 to encircle a wood bundle in the compression section. When the strap is then drawn tight (after the bundle has been compressed), the strap is withdrawn from the strapping track by overcoming the spring bias in the covers (not shown) and drawn into tight encircling relationship around the bundle. The strap is then sealed and cut and the track is then supplied with additional strap for the next bundle.

As shown best in FIG. 1, the banding material is supplied from a container 66 having guides 67 and 68 through which strap 60 is fed to control unit 58. As indicated in FIG. 1, an automatic actuator device 69 is preferably connected with guide 67 so that automatic feeding of band material 60 from container 66 is terminated when sufficient band has been provided. Obviously, feed band could be manually fed from container 66 if desired.

As is also shown in FIG. 1, a reel 71 of wire clips 72 is also provided. Wire clips are fed to sealer unit 61 where they are conventionally placed on a strap that has been tightly drawn around wood bundled and under compression in the compression section 16. Sealer unit 61 is conventional and crimps a seal over the end portions of a strap which is around a wood bundle in conventional fashion.

As also indicated in FIG. 1, a pneumatic (air) system 74 is also provided to automatically cause sequencing of steps in the wood bundling device of this invention. As indicated in FIG. 1, air under pressure for the pneumatic system is provided by motor 75 connected with pump 76 which, in turn, is conventionally connected with reservoir 77. Air line 78 is provided from reservoir 77 to control unit 80 which, as shown in FIG. 1, has mounted thereon a plurality of switches shown to be of push-button type. The switches shown include switch 81 which is off/on switch, switch 82 which is an emergency stop switch, switch 83 which is a cycle-start switch, and switch 84 which is a manual feed switch for banding material 60. In addition, a pilot light 85 also appears on the control panel and is an indication that the system is energized.

Turning now to FIG. 10, a flow diagram is shown of the pneumatic control system for the banding, or strapping, section. As shown in FIG. 10, conduit 78 from air reservoir 77 is coupled through filter 87, regulator 88 and lubricator 89 to a plurality of valves 92, 93 and 94. Valve 92 is controlled by solenoid 96, valve 93 is controlled by solenoid 97 and valve 94 is controlled by solenoids 98 and 99. As also indicated in FIG. 10, the valves are normally biased to one position (unless moved therefrom by actuation of the solenoids) by means of springs 102, 103, 104 and 105. Springs 104 and 105 position three-position valve 94 in the center position unless actuated therefrom by solenoids 98 or 99. In addition, regulator 108 having an indicator 109 connected therewith may also be placed in the line leading to valve 93. As also indicated in FIG. 10, feed indication lamp 111 may be provided at the output line of valve 94.

The conduits 114 from valve 92 are coupled to sealer ram cylinder 115, which form a part of sealer assembly 61. While not indicated in detail, it is to be appreciated that activation of valve 92 will cause actuation of the ram of cylinder 115 to cause a seal (a clip) to be applied to the strap after it has been pulled tight around a wood bundle. In like manner, conduits 117 from valve 93 are connected with the high-tension ram 118. Actuation of valve 93 causes tension to put on the strap after the wood has been compressed in the compression section of the wood bundler of this invention. High-tension ram 118 is positioned to pull the strap tightly around the wood bundle and can be positioned, for example, in control box 58.

Valve 94, a three-position valve, and conduits 120 therefrom are connected with pneumatic motor 121 which, depending on actuation of valve 94, either takes up slack or feeds additional strap to the unit as needed or desired.

Additional valves and cylinders may be provided as needed. For example, track covers may be opened and closed with air actuated cylinders and, when so utilized, a solenoid to control such covers along with control of associated elements such as hold pawls and straight roll may also be provided. If so utilized, an additional solenoid is also used with the pneumatic control system, as shown in FIG. 8, where solenoid 150 is shown to control valve 95 having spring 106 associated therewith, the output from valve 95 being connected with hold pawl cylinder 124, rear cover cylinder 125, front cover cylinder 126, and straight roll cylinder 127.

Figure 8:
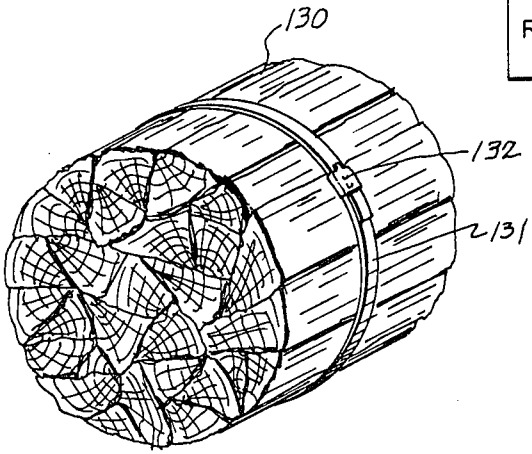
FIG. 8 is a perspective view illustrating a firewood bundle formed by the firewood bundling system of this invention as shown in FIGS. 1 through 7.
Figure 4:
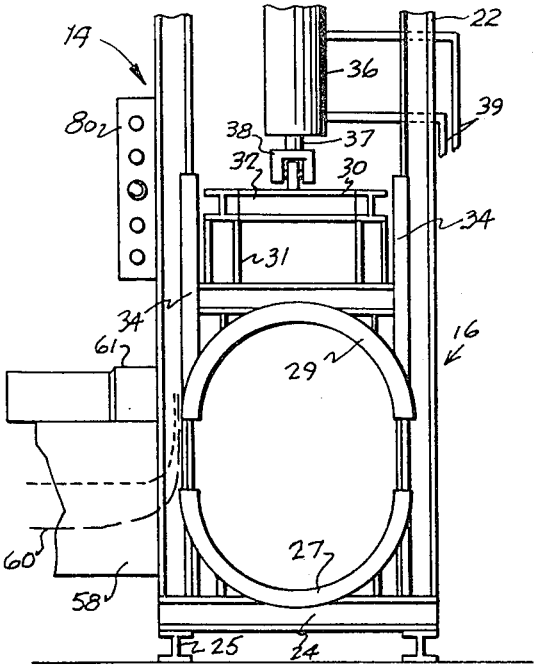
FIGS. 4 through 7 are partial side views of the compression means of the firewood bundling apparatus of this invention illustrating forming of a firewood bundle therebetween.
Figure 5:
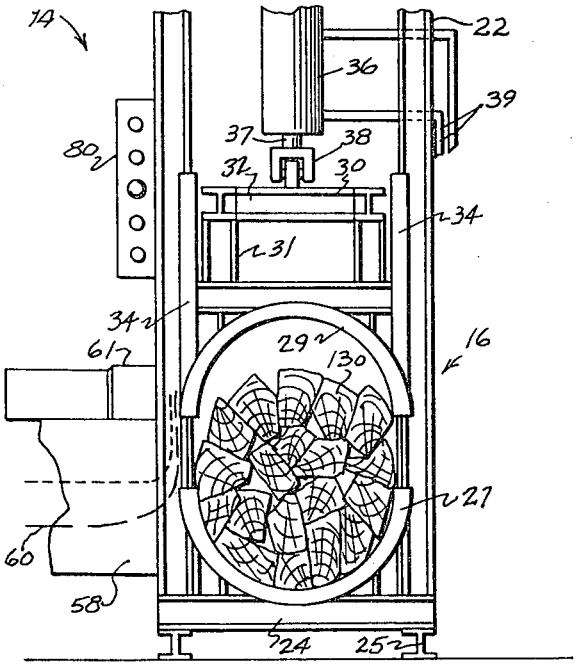
Figure 6:
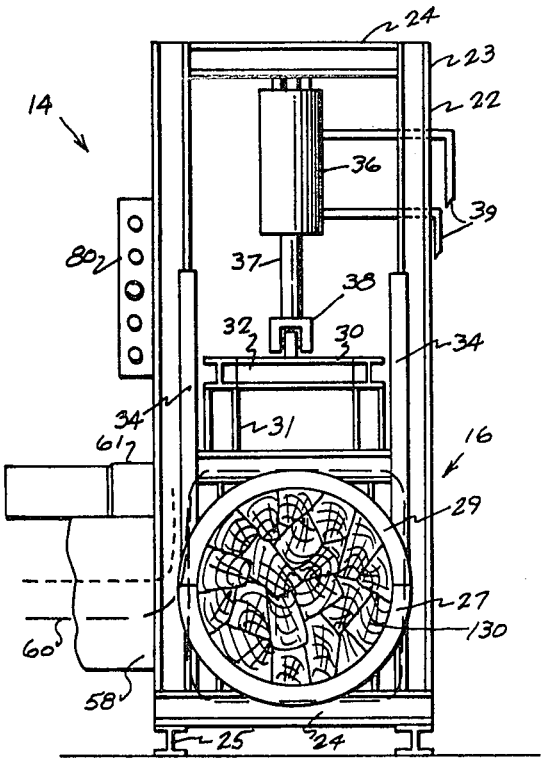
Figure 7:
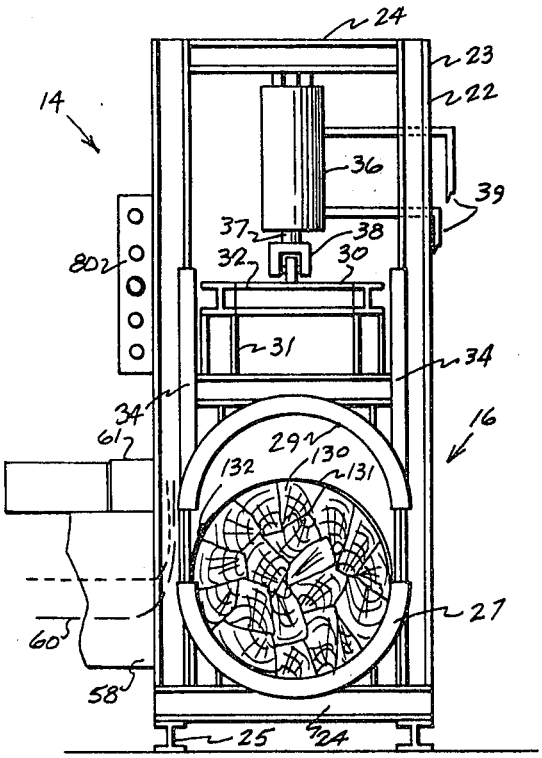

A bundle of wood logs 130 is indicated in FIG. 8 with the bundle tightly bound in a cylindrical bundle by strap 131 therearound with the strap being fastened by clip 132. As illustrated in FIG. 8, due to the pressures exerted and to the configuration of U-shaped members 27 and 29, a cylindrical bundle of firewood is achieved by a single strap around the central portion of the bundle, FIGS. 4 through 7 illustrate how that such a bundle is formed with FIG. 4 showing the device in the open, or loading, position, and FIG. 5 showing fireplace logs 130 loaded into the machine with end portions of the logs being supported by the lower U-shaped members 27. FIG. 6 shows the device in the compressed position with the wood contoured into a circular configuration, and FIG. 7 shows the bundled wood with the strap having been applied thereto and the pressure removed from the bundle so that the bundle is then ready to be removed from the device and more wood inserted therein to form another bundle.

FIG. 11 illustrates the electrical control schematic of this invention and shows the automatic sequencing achieved through use of the electro-pneumatic system of this invention, the electrical system, of course, controlling the pneumatic system of the device. As shown in FIG. 11, time-delay relay 133 is connected in series with solenoid 134 (which is solenoid 42 as earlier indicated) and controls actuation of normally open switch 135.

Upon closing of cycle-start switch 83 (and with emergency stop switch 82 not being actuated to open position and the off/on switch 81 being in the closed position), the line current is available to the time-delay to energize the same and also to energize solenoid 134 which causes actuation of cylinder 36 to cause the pressure platen to be moved downwardly to close the distance between the upper and lower U-shaped members in the compression section, as shown in Fig. 6. When time-delay relay 133 times out, then switch 135 is closed in order to allow the various strapping steps to take place. At the same time that time-delay relay 133 is energized, time-delay relay 136 is likewise energized since it is connected in parallel therewith as indicated in FIG. 11. When relay 136 is energized, switch 137, which is normally open, is closed and this then provides a holding circuit around the cycle-start switch 83. At the same time, slack take-up solenoid 148 (which is identified as solenoid 98 heretofore) is energized so long as switch 149 remains closed and this actuates motor 121 to remove any excess strap slack that may have been in the track of the strapping section.

After a predetermined time, timed switch 149 opens and this de-energizes solenoid 148 and stops motor 121. When switch 149 opens, switch 155 is timed to close and through switch 154, if utilized, causes high-tension solenoid 153 (which is identified as solenoid 97 heretofore) to be energized, as well as timed-delay relay 157. As the ram of hightension cylinder 118 (controlled by solenoid 153) partially extends, switch 154, if utilized, is opened to de-energize the high-tension solenoid 153 causing the ram in the hightension cylinder 118 to retract whereupon solenoid 153 is again energized and this reciprocal action will continue until timed switch 162 closes to energize sealer head solenoid 159 (identified heretofore as solenoid 96) through sealer head safety switch 160. The ram of sealer head cylinder 115 (controlled by solenoid 159) extends when solenoid 159 is energized to crimp the seal about the strap ends and, at the same time, the strap is cut as is conventional.

After the strap is cut, the ram of high-tension cylinder 115 is completely extended and actuates a single-pull, double-throw limit switch 146 so that the normally closed contacts of switch 146 open and this de-energizes time-delay relay 136, opens switch 137, and de-energizes sealer head solenoid 159, high-tension solenoid 153 and pressure valve solenoid 134. De-energization of solenoid 134 causes valve 41 to re-assume its normal position (as shown in FIG. 9) and the ram of hydraulic ram assembly 36 is retracted to move movable U-shaped member 27 upwardly away from U-shaped member 29. In addition, relays 136 and 157 are de-energized.

After the ram of sealer head cylinder 115 is retracted, the normally open contacts of switch 143 close to energize relay 140 and solenoid 144 (identified heretofore as solenoid 99) through limit switch 141. The normally open contacts of switch 142 close when relay 140 is energized and becomes a holding circuit for relay 140, strap feed solenoid 144 and manual feed switch 84. When solenoid 144 is energized, motor 121 feeds strap around the track 57 until the end of the strap opens limit switch 141 located at a point to sense that strap has completely encircled the compression area. The opening of the contacts of switch 141 de-energizes relay 140 and this causes the holding contacts of switch 142 to open so that solenoid 144 is de-energized and the apparatus is returned to the initial position and thus ready for the next cycle.

In addition, if a solenoid is provided to control the covers and provide hold pawls (as indicated could be utilized in connection with FIG. 10), then such a solenoid (indicated as solenoid 151 in FIG. 11 and 100 in FIG. 10) would be energized when switch 135 is closed and deenergized when switch 135 is later opened.

While steel strap has been found to be preferable for use in this device, the invention is not meant to be limited thereto, and other strap material, such as plastic or nylon, for example, might be utilized if sufficiently strong to maintain the binding on the bundle during normal usage.

In operation, the wood pieces, preferably fireplace logs, are loaded into the compression section of the device while the device is in the initial, or open, position, as shown in FIG. 4, after which the cycle-start switch 83 is closed and this causes the device to automatically sequence through the various steps to first apply pressure and compress the wood after which the strap is caused to be automatically applied around the central portion of the wood pieces while the compression is maintained. The pressure is then removed from the device and the wood bundle is then removed, the wood bundle being tightly bound and having a cylindrical configuration as indicated in FIG. 8.

As can be seen from the foregoing, this invention provides a method for tightly bundling firewood, the apparatus including an electro-pneumatic system for providing automatic sequencing to tightly bind the bundle.

What is claimed is:

1. A method for bundling firewood, said method comprising:

providing an assembly having first and second sections at a predetermined work area with one of said sections being movable toward and away from the other of said sections, each of said sections having spaced portions engageable with only the outer portions of pieces of firewood to be bundled at said work area;

placing a plurality of pieces of firewood between said first and second sections at said predetermined work area;

providing a control system including an electrical system;

providing actuating means controlled by said control system for causing movement of said one section toward and away from said other section;

applying a multi-ton pressure to only the outer end portions of said pieces of firewood while at said work area by said actuating means causing movement of said one section toward said other section to compress said work pieces into a bundle having a predetermined configuration;

providing a strapping means at said work area controlled by said control system;

applying a strap by said strapping means to the middle portion of said firewood bundle while maintaining said multi-ton pressure on the outer end portions of said bundle; and releasing the pressure on the outer end portions of said bundle by said actuating means causing movement of said one section away from said other section after said strap has been applied to said bundle so that the bundle is thereafter maintained compressed by only the strap in a tight bundle.

2. The method of claim 1 wherein pressure of at least 5 tons is applied to the outer end portions of said pieces of firewood.

3. The method of claim 1 wherein a steel band is applied to said firewood bundle.

4. The method of claim 1 wherein hydraulic pressure is applied to the outer end portions of said pieces of firewood by said actuating means, and wherein said strap application and application of hydraulic pressure is automatically sequenced by said control system to enable repeated like operation.

5. A method for bundling firewood, said method comprising: placing a plurality of pieces of firewood at a predetermined work area;

applying a multi-ton pressure to only the outer end portions of said pieces of firewood at said work area to compress said work pieces into a bundle having a predetermined configuration;

applying a strap to the middle portion of said firewood bundle while maintaining said multi-ton pressure on the outer end portions of said bundle;

releasing the pressure on the outer end portions of said bundle after said strap has been applied to said bundle so that said firewood peices are thereafter maintained in said bundle by said strap;

electrically controlling application and release of said pressure and application of said strap to said pieces of firewood; and removing said strapped bundle from said work area.

6. The method of claim 5 wherein a pair of relatively movable pressing means are positioned at said predetermined work area with said pieces of firewood being placed therebetween, and wherein said application of a multi-ton pressure includes moving one of said pressing means toward the other so that said multi-ton pressure is applied to said pieces of firewood between said pressing members to compress the fire-wood pieces.

7. The method of claim 5 wherein said applied multi-ton pressure causes said firewood pieces to be compressed into a substantially cylindrical bundle.

8. The method of claim 5 wherein said applied multi-ton pressure is applied by said actuating means that includes actuating a hydraulic ram assembly.

9. A method for bundling wood suitable for use as logs in a wood burning fireplace, said method comprising:

providing an assembly having first and second sections one of which is movable toward and away from the other of said sections, each of said sections having spaced U-shaped portions that face one another;

placing a plurality of pieces of wood between said sections so that said U-shaped portions of said section are engageable with the outer end portions of said pieces of wood;

providing a control system including an electrical system;

providing a hydraulic ram assembly controlled by said electrical system to cause movement of said one section relative to said other section and causing movement of said one section toward said other section to cause compression and contouring of said wood between said sections into a bundle of predetermined configuration by application of multi-ton pressures to only the end portions of said portions of said pieces of wood;

providing a strapping means controlled by said electrical system;

applying a strap by said strapping means around the central portion of said compressed wood bundle while said bundle is held compressed at the outer portions between the U-shaped portions of said sections of said assembly; and causing said hydraulic ram assembly to move said one section away from said other section of said assembly after a strap has been applied to said wood bundle.

10. The method of claim 9 wherein said applied pressure is in the range of about 5 to 15 tons.

11. The method of claim 9 wherein a steel strap is applied around the central portion of said wood bundle.

12. The method of claim 9 wherein each step controlled by said electrical system is timed by electric timing means of said electrical system to effect the wood bundle.

* * * * *

UNITED STATES PATENT AND TRADEMARK OFFICE

CERTIFICATE OF CORRECTION

PATENT NO. : 4,072,094

DATED : February 7, 1978

INVENTOR(S) : Stephen N. Smitherman and Lemuel A. Dougherty

It is certified that error appears in the above-identified patent and that said Letters Patent are hereby corrected as shown below:

Column 1, line 62, "on" should be "of"
Column 3, line 36, "above aligned" should be "above and aligned"
Column 4, line 47, "prefferred" should be "preferred"
Column 5, line 12, "bank" should be "band"
Column 5, line 13, "AS" should be "As"
Column 5, line 56, "which is off/on" should be "which is an off/on"
Column 7, line 6, "time-delay" should be "time-delay relay"

Signed and Sealed this

*Fourth* Day of *July 1978*

[SEAL]

*Attest:*

RUTH C. MASON
*Attesting Officer*

DONALD W. BANNER
*Commissioner of Patents and Trademarks*